US005121675A

United States Patent [19]

Müller et al.

[11] Patent Number: 5,121,675

[45] Date of Patent: Jun. 16, 1992

[54] DEVICE FOR SUPPLYING AIR TO AND IF NEED BE EVACUATING AIR FROM A ROOM

[75] Inventors: Gottfried Müller; Paul Hipp, both of Kolbingen, Fed. Rep. of Germany

[73] Assignee: Schako Metallwarenfabrik Ferdinand Schad KG, Kolbingen, Fed. Rep. of Germany

[21] Appl. No.: 582,861

[22] PCT Filed: Feb. 5, 1989

[86] PCT No.: PCT/DE90/00076

§ 371 Date: Dec. 4, 1990

§ 102(e) Date: Dec. 4, 1990

[87] PCT Pub. No.: WO90/08926

PCT Pub. Date: Aug. 9, 1990

[30] Foreign Application Priority Data

Feb. 4, 1989 [DE] Fed. Rep. of Germany ..... 3903311

[51] Int. Cl.[5] ..... F24F 13/065

[52] U.S. Cl. ..... 454/305; 454/286; 454/331

[58] Field of Search ..... 98/40.02, 40.1, 40.11, 98/40.18, 101, 108, 104

[56] References Cited

U.S. PATENT DOCUMENTS

| | | | |
|---|---|---|---|
| 1,177,779 | 4/1916 | Kerch | 98/104 |
| 3,012,494 | 12/1961 | Drummond | 98/40.02 |
| 3,942,419 | 3/1976 | Beach | 98/40.02 |
| 4,794,851 | 1/1989 | Kurrle | 98/40.02 X |
| 4,966,069 | 10/1990 | Müller et al. | 98/40.11 |

FOREIGN PATENT DOCUMENTS

| | | | |
|---|---|---|---|
| 149203 | 7/1985 | European Pat. Off. | 98/40.18 |

*Primary Examiner*—Harold Joyce
*Attorney, Agent, or Firm*—Bachman & LaPointe

[57] ABSTRACT

In a device for aerating and, if necessary, deaerating a space by means of individual nozzles arranged in a casing box (4, 4*a*), at least one individual nozzle (14) is rigidly mounted in a nozzle grid (5, 5*a*) arranged so as to swivel about an axis of the casing box (4, 4*a*).

6 Claims, 2 Drawing Sheets

DEVICE FOR SUPPLYING AIR TO AND IF NEED BE EVACUATING AIR FROM A ROOM

BACKGROUND OF THE INVENTION

The invention relates to a device for supplying air to and if need be evacuating air from a room by means of individual nozzles arranged in a casing box.

Nozzles are known which can be adjusted as individual nozzles either by a servomotor or by hand. Hot or cold air is fed into a room by means of these individual nozzles. In the case of these individual nozzles, the considerable expenditure on assembly is disavantageous, since a motor has to be allocated to each individual nozzle or else the manual adjustment is made for each individual nozzle.

The aim of the inventors is to develop a device of the aforesaid type, by means of which the introduction of intake air into a room can be substantially better controlled and the assembly of which is facilitated.

The foregoing object is achieved when at least one individual nozzle is rigidly inserted into a nozzle grille and the latter is arranged so as to be swivellable about an axis of the casing.

On the one hand, there is the advantage here that the individual nozzle itself need not be adjusted, but rather the adjustment is made via the nozzle grille. Furthermore, a plurality of individual nozzles will be combined in one nozzle grille as a rule, so that a plurality of individual nozzles are always adjusted given an adjustment of the nozzle grille. In a ventilation grille conceived in this way, a plurality of nozzle grilles having a plurality of individual nozzles can be inserted in individual rows or consecutive rows. All these grilles or only certain of them can be adjusted together via a servomotor. For example, swivelling out of the longitudinal axis is possible when the ventilation grille is fitted in a wall. If the nozzles are swivelled here in the direction of the floor of the room, the introduction of warm air is improved. If the nozzle axes remain in a horizontal plane, then this ventilation grille serves to introduce isothermal air. When cold air is introduced, however, the nozzles axes are directed toward the ceiling of the room so that no drafts occur.

With this ventilation grille, an operator has the advantage that the incoming fresh air passes relatively reliably into the room interior and the room is scavenged very effectively. With reference to appropriate diagrams, a user of the unit or a relevant fitter can determine the length of throw that he can reliably reach with the nozzles. The individual nozzle grilles are also supplied with nozzles of various diameter so that virtually every room depth can be filled with fresh intake air without problem. Of course, this also depends on the quantity of air fed in. The nozzle grilles are very quiet and can release a considerable quantity of air.

A nozzle grille preferably consists of a frame strip which is adapted to the inner contours of the casing box. If only swivelling out of the longitudinal axis of the casing box is desired, then this frame strip is not secured laterally. However, rotation of the nozzle grille about the longitudinal axis of the casing box is also to be possible and is to be included by the present idea behind the invention. In this case, the casing box then has a lateral bulge so that swivelling of the nozzle grille about the longitudinal axis of the casing is not impaired.

The frame strip in turn preferably encloses plates into which the individual nozzles are inserted and to which the individual nozzles are firmly connected.

In the present exemplary embodiment, the nozzle grille is connected to the casing box via fixing straps, these fixing straps being located opposite one another and forming an axis of rotation for the nozzle grille.

In this way, a very easy and simple adjustment of the nozzle grille to the top or bottom can be made.

A servomotor, for example, is suitable for swivelling the nozzle grille. Manual swivelling is of course also possible, the nozzle grille then preferably being secured in a certain position. A relatively large number of individual nozzles can be adjusted by means of a single drive or manually so that there is a considerable saving in assembly costs and power consumption.

In a further exemplary embodiment of the invention, air slits also partly pass through the nozzle grilles. It is thus possible to draw vitiated air out of a room without disturbing the intake air. The nozzles throw the intake air relatively far into the room so that no short circuit, i.e. no direct diversion of the intake air, results. In conventional grilles, the admission velocity is too small to permit such a combination of intake-air and vitiated-air grille.

Of course, this ventilation grille according to the invention is suitable for both wall and ceiling fitting. It can be used in any length or width, with or without ball protection.

BRIEF DESCRIPTION OF THE DRAWINGS

Further advantages, features and details of the invention follow from the description below of preferred exemplary embodiments as well as with reference to the drawing, in which.

DETAILED DESCRIPTION

Figure 1:
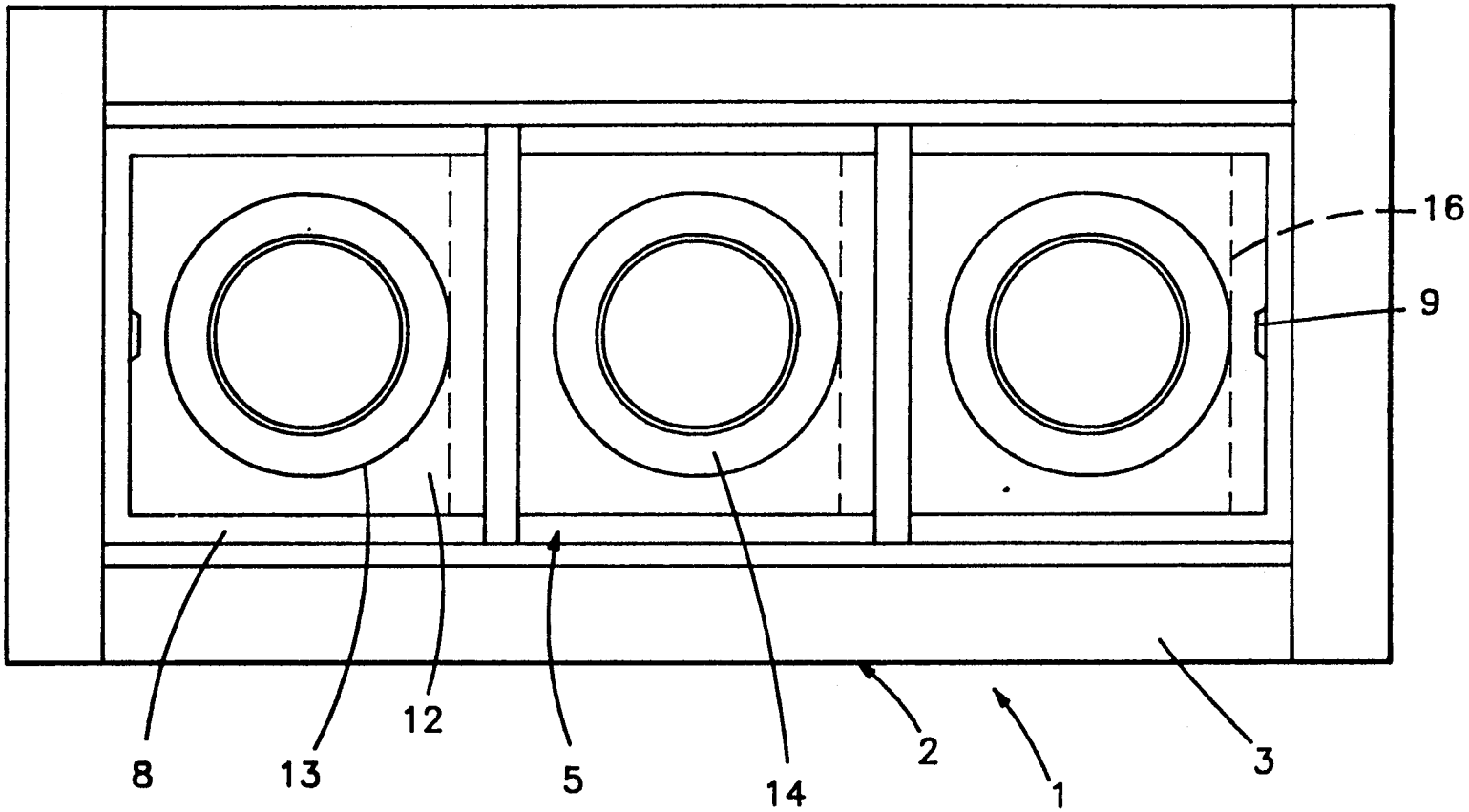
FIG. 1 shows a front view of a ventilation grille according to the invention.
Figure 3:
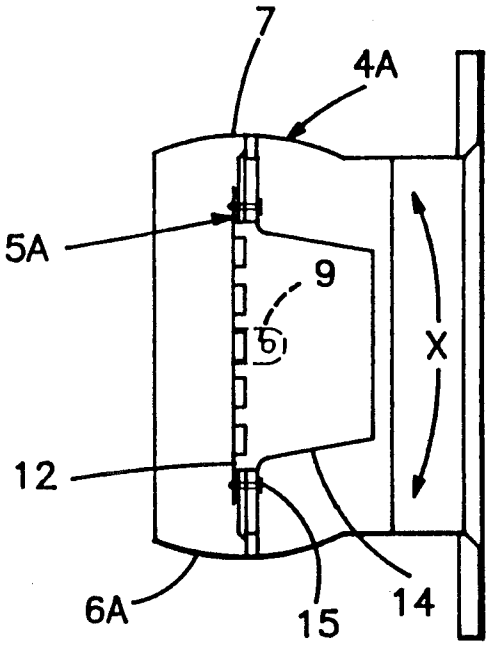
FIG. 3 shows a cross-section through a further exemplary embodiment of a ventilation grille in accordance with that according to FIG. 1.

According to FIG. 1, a ventilation grille 1 has a grille frame 2 which essentially consists of cover strips 3 as well as a roughly rectangular casing box 4. The cover strips 3 enclose the casing box 4 as a collar. Said grille frame 2 is fitted (not shown in more detail), for example, into a wall or a ceiling. entire surface. FIG. 3, on the other hand, shows a casing box **4*a* having side walls 6*a* which partly have bulges 7**.

Nozzle grilles 5 and **5*a* are inserted into the casing boxes 4 and 4*a* respectively. Each nozzle grille 5 or 5*a* has a frame strip 8 via which the nozzle grille 5 or 5*a* is supported against the side walls 6 and 6*a*** respectively.

In the exemplary embodiment according to FIG. 3, the nozzle grille **5*a* sits in the area of the bulges 7**.

The nozzle grilles 5 and **5*a* are connected to the casing boxes 4 and 4*a* respectively only via end fixing straps 9 which have a bore 10, for example for accommodating a corresponding screw or rivet. Said bores 10 at the same time form a swivel mounting, as a result of which the inclination of the nozzle grille 5 or 5*a* inside the casing box 4 or 4*a*** can be changed.

Connected to the frame strip 8 are roughly square plates 12 which have a central aperture 13. Individual nozzles 14 are inserted into the aperture 13 and are connected to the plate 12 via corresponding screws 15.

A plurality of such individual nozzles 14 are preferably provided for one nozzle grille 5.

Furthermore, the arrangement of vitiated-air slits 16 is shown by broken lines in FIG. 1, in which arrangement a separate feed for the intake air to the individual nozzles 14 and extraction of the vitiated air from the vitiated-air slits 16 then also adjoins the casing box 4 or 4*a*.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

Figure 2:
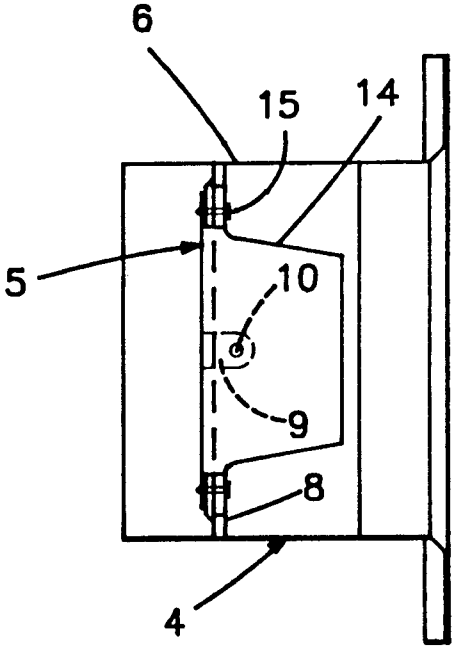
FIG. 2 shows a cross-section through the ventilation grille according to FIG. 1.

According to FIG. 2, the casing box 4 has side walls 6 which are of planar configuration over their

We claim:

1. A device for selectively supplying and exhausting air from a room comprising:

a frame for mounting the device in said room, said frame including a casing box;

at least one nozzle grille pivotably mounted within said casing box;

a plurality of nozzles within said at least one nozzle grille and fixed thereto for unitary movement therewith; and means for selectively pivoting said at least one nozzle grille within said casing box for pivoting said plurality of nozzles in unison therewith.

2. The device as claimed in claim 1, wherein said nozzle grille includes a frame member pivotably mounted to said casing box wherein said frame member has an exterior contour which conforms with an interior contour of said casing box.

3. The device as claimed in claim 2, wherein said nozzle grille further includes at least one plate means secured to said frame member and defining at least one nozzle opening.

4. The device as claimed in claim 3, wherein one of said plurality of nozzle is fixed to said at least one plate means and is associated with one of said at least one nozzle opening.

5. The device as claimed in claim 2, wherein said frame member is pivotably mounted by bracket means to said casing box.

6. The device as claimed in claim 1, wherein a plurality of nozzle grilles are pivotably mounted within said casing box.

* * * * *